US006462316B1

(12) United States Patent
Berkcan et al.

(10) Patent No.: US 6,462,316 B1
(45) Date of Patent: Oct. 8, 2002

(54) COOKTOP CONTROL AND MONITORING SYSTEM INCLUDING DETECTING PROPERTIES OF A UTENSIL AND ITS CONTENTS

(75) Inventors: Ertugrul Berkcan, Niskayuna; Vivek Venugopal Badami, Schenectady; Paul Randall Wilson, Scotia; Emilie Thorbjorg Saulnier, Rexford, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/684,426

(22) Filed: Oct. 10, 2000

(51) Int. Cl.[7] ..... H05B 1/02; H05B 3/68
(52) U.S. Cl. ..... 219/502; 219/447.1
(58) Field of Search ..... 219/445.1, 446.1, 219/447.1, 448.1, 448.12, 448.13, 460.1, 461.1, 502, 509, 510, 518

(56) References Cited

U.S. PATENT DOCUMENTS

| | | | | |
|---|---|---|---|---|
| 3,885,128 A | | 5/1975 | Dills | |
| 4,493,980 A | | 1/1985 | Payne | |
| 4,493,981 A | | 1/1985 | Payne et al. | |
| 4,740,664 A | * | 4/1988 | Payne et al. | 219/448.11 |
| 4,816,647 A | | 3/1989 | Payne | |
| 5,079,407 A | | 1/1992 | Baker | |
| 5,243,172 A | * | 9/1993 | Hazan et al. | 219/447.1 |
| 5,900,174 A | * | 5/1999 | Scott | 219/447.1 |
| 6,111,228 A | * | 8/2000 | Berkcan et al. | 219/446.1 |
| 6,118,105 A | | 9/2000 | Berkcan et al. | |
| 6,140,617 A | * | 10/2000 | Berkcan et al. | 219/446.1 |
| 6,225,607 B1 | * | 5/2001 | Has et al. | 219/448.11 |
| 6,281,481 B1 | * | 8/2001 | Tiemann | 219/446.1 |
| 6,285,012 B1 | * | 9/2001 | Connolly et al. | 219/448.11 |

OTHER PUBLICATIONS

"Monitoring and Control System for Monitoring the Temperature of a Glass Cooktop," E. Berkcan et al., Ser. No. 09/356,964 (GE docket RD–26,381) filed Jul. 7, 1999.

"Cooktop Control and Monitoring System Including Detecting Properties of a Utensil Through a Solid–Surface Cooktop," E. Berkcan et al., Ser. No. 09/422,768 (GE docket RD–26,382) filed Oct. 22, 1999.

* cited by examiner

*Primary Examiner*—Sang Paik
(74) *Attorney, Agent, or Firm*—John F. Thompson; Jill M. Breedlove

(57) ABSTRACT

A system for automatically controlling the temperature of the cooking surface of a cooking surface of a solid-surface cooktop and, consequently, the temperature of the cooking utensil on the cooking surface, by detecting cooking utensil-related properties through the solid-surface cooktop. The cooking utensil-related properties include presence/absence, removal/placement, and other physical properties such as utensil type, size, warpage, and temperature and load size. Automatic control is based on monitoring the heat transfer characteristics from the energy source to the cooktop and the utensil to infer the utensil properties. This is achieved by sensing or inferring a parameter indicative of the temperature of a monitored area that includes at least a portion of the cooktop or of the cooking utensil placed on the upper surface of a cooktop, as well as a parameter indicative of power applied to a controllable heat source, and detecting signal properties using an evolutionary algorithm.

31 Claims, 8 Drawing Sheets

COOKTOP CONTROL AND MONITORING SYSTEM INCLUDING DETECTING PROPERTIES OF A UTENSIL AND ITS CONTENTS

BACKGROUND OF THE INVENTION

The present invention relates generally to monitoring and/or controlling an electric cooktop, and, more particularly, to a system for generating control signals responsive to properties of a cooking utensil detected by using a parameter indicative of the temperature of the cooktop surface.

Recently, standard porcelain enamel cooktop surfaces of domestic ranges have been replaced by smooth, continuous-surface, high-resistivity cooktops located above one or more heat sources, such as electrical heating elements or gas burners. The smooth, continuous-surface cooktops are easier to clean because they do not have seams or recesses in which debris can accumulate. The continuous cooktop surface also prevents spillovers from coming into contact with the heating elements or burners. Exemplary cooktops comprise glass-ceramic material because of its low coefficient of thermal expansion and smooth top surface that presents a pleasing appearance.

Devices are known for detecting the presence of a utensil on a cooking appliance, such as those dependent on contact with the cooking utensil disposed on an electric heating element or on the utensil support of a gas burner. Such contact-based systems, however, have not proven to be feasible for continuous-surface cooktops, and especially glass-ceramic cooktops due to the difficulties of placing contact sensors thereon. Cooking utensil contact sensors generally disrupt the continuous cooktop appearance, weaken the structural rigidity of the cooktop, and increase manufacturing costs. Also, such contact-based systems are not inherently reliable on smooth-surface cooktops because cooking utensils with warped or uneven bottoms may exert varying forces on the contact sensors and give a false contact indication.

None of the known arrangements include an algorithm that compares a combination of signals indicative of temperature of a cooking utensil and/or the solid cooktop surface and power applied to one or more heat sources used for cooking to determine the physical properties of the cooking utensil. In addition, no known arrangement uses an algorithm that learns with experience.

Accordingly, it is desirable to provide a system for detecting cooking utensil characteristics or utensil-related, through-the-cooktop-surface properties, such detection being independent of a cooking utensil's composition, flatness of bottom, or weight. Such a desirable system should perform such detection with an evolutionary algorithm that processes temperature and power signals. It is further desirable that such a system generate energy source control signals based on detecting temperature indicative signals through the glass-ceramic cooktop, and processing such signals together with power indicative signals, to determine the presence/absence, removal/placement, warpage, size, temperature, or the contents or load of a cooking utensil on the cooktop.

BRIEF SUMMARY OF THE INVENTION

The system of the present invention is arranged and configured for automatically controlling the temperature of the cooking surface of a cooking surface of a solid-surface cooktop, and, consequently, the temperature of the cooking utensil on the cooking surface, by detecting cooking utensil-related properties through the solid-surface cooktop. The cooking utensil-related properties include presence/absence, removal/placement, and other physical properties such as utensil type, size, warpage, temperature, and load size.

The approaches disclosed herein are primarily based on monitoring the heat transfer characteristics from the energy source to the cooktop and the utensil to infer the utensil properties. This is achieved by sensing or inferring a parameter indicative of the temperature of a monitored area that includes at least a portion of a cooktop or of the cooking utensil placed on the upper surface of a cooktop. The temperature parameter sensor includes at least one detector, and additional sensors may be used for sensing other parameters for improved detection capability. A second parameter indicative of power applied to at least one controllable energy source (e.g., comprising electric or gas heating elements or induction heating sources) is sensed and a power signal is developed for subsequent processing, together with the parameter indicative of temperature.

The at least one controllable energy source is arranged to heat the contents of a cooking utensil placed on the cooktop. The utensil property detecting system may include a monitoring system for monitoring the properties of the cooking utensil, or it may include a control system for controlling the energy source based on the detected utensil properties, or both.

In one embodiment, the sensor is arranged to detect the temperature of the cooktop directly in contact with the cooking utensil. The characteristics of the temperature changes of the cooktop are dependent upon the type, size and other characteristics of the cooking utensil, as well as the power level of the energy source and the temperature of the cooktop. The impact of various types, sizes and condition of a cooking utensil on the cooktop on temperature is determined experimentally and stored as data within a processor, which receives the signal indicative of temperature from the sensor. The processor selects a power level, processes the received signal indicative of temperature, and compares the result to the stored data, thereby determining the type, size and other characteristics of the cooking utensil. Based on the detected signals, the processor employs an algorithm to provide signals indicative of the status of the cooking utensil. In a separate embodiment, the detected signals are used by the processor to provide control signals to the energy source in order to optimally support the particular cooking utensil or cooking mode set by the user of the cooktop.

In a separate embodiment, heat transfer models based on predetermined physical characteristics of utensils and power and heat flux properties are used for estimation or inferral of utensil temperature.

In all embodiments of the present invention, an algorithm employed by the processor processes a combination of signals including the signal indicative of temperature related to the solid cooktop surface and/or the cooking utensil located on the surface, and also a signal indicative of the power going to one or more heat sources used for cooking, to determine the physical properties of the cooking utensil. The algorithm can be an evolutionary algorithm that updates comparison rules in accordance with calculated differences between detector signal levels and known signal patterns.

DETAILED DESCRIPTION OF THE INVENTION

Figure 1:
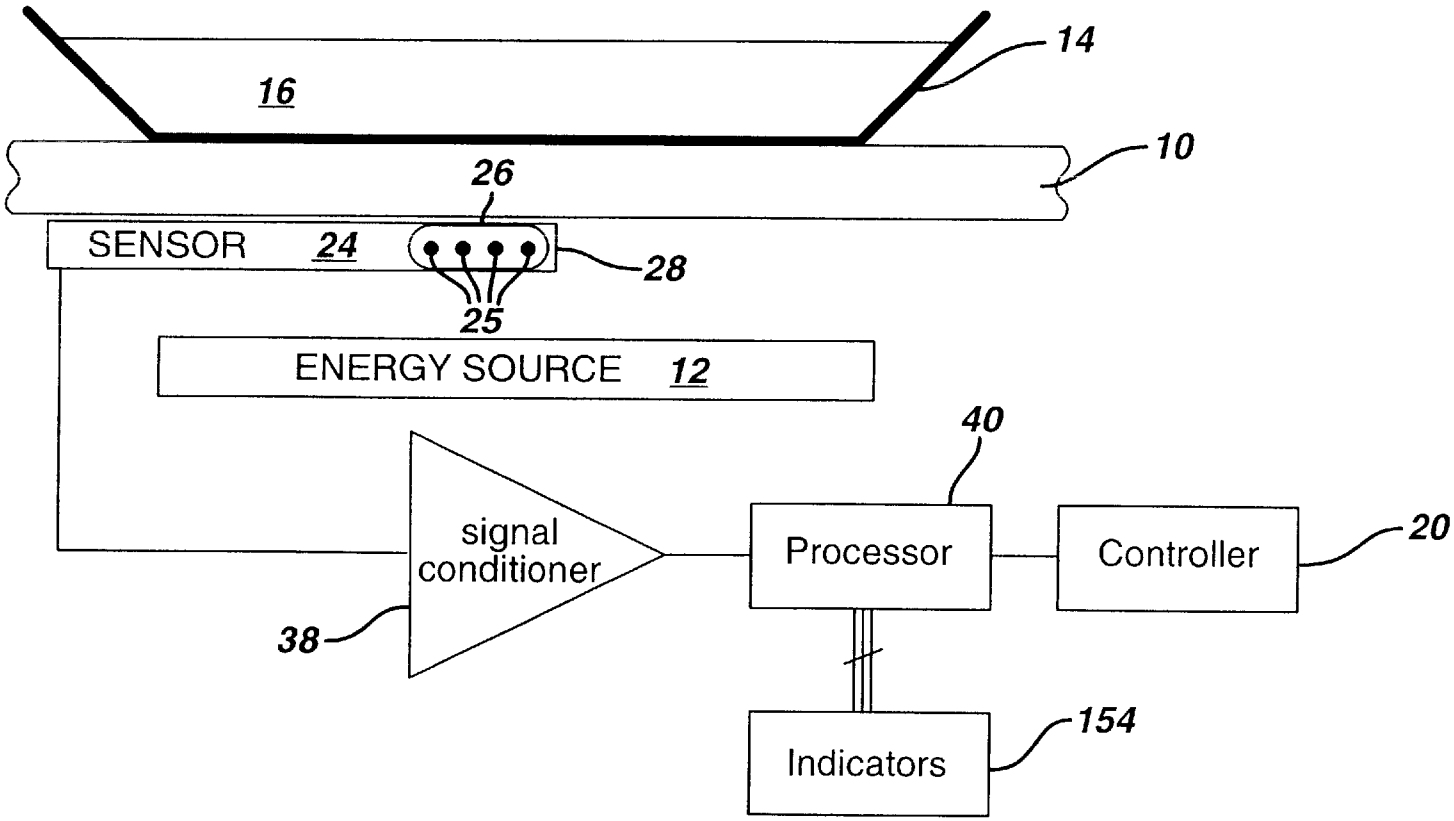
FIG. 1 is a block diagram illustrating a glass-ceramic cooktop incorporating a cooking utensil property detecting system according an exemplary embodiment of the present invention.

FIG. 1 illustrates a cooktop 10 made of any suitable solid material, preferably glass-ceramic, having a lower surface 10*a* and an upper surface 10*b*. At least one controllable energy source, represented schematically by a block 12, is located beneath the lower surface 10*a*. Energy source 12 may comprise any suitable energy source, such as electric or gas heating elements or induction heating sources, for example. A cooking utensil 14 (e.g., a pan or cooking utensil) containing contents 16 is illustrated as located on the upper cooking surface 10*b*. An energy source controller 20 is shown as being electrically connected to energy source 12, for providing signals to energy source 12.

FIG. 1 further illustrates a sensor indicative of temperature 24 for sensing the temperature parameter affected by the cooking utensil 14, as being located directly below the cooktop as a non-limiting example. Alternatively, sensor 24 can be located at any point beneath, or adjacent to, the cooktop, and can abut a surface of the cooktop. Sensor 24 can be in thermal contact with, or thermally affected by, the glass ceramic cook top. Sensor 24 can include a contact type, optical, or ambient flux type detector. Sensor 24 provides signals indicative of cooking utensil properties via a signal conditioner 38 to a processor 40. Signals provided by sensor 24 optionally represent direct detection of, or inferentially refer to, temperature of at least one of at least a portion of the upper surface 10*b* of the cooktop and the cooking utensil placed on the upper surface 10*b* of the cooktop. Sensor indicative of temperature 24 may be temperature compensated for some applications. Such temperature compensation may be accomplished using a signal indicative of the ambient temperature around sensor indicative of temperature 24.

Figure 2:
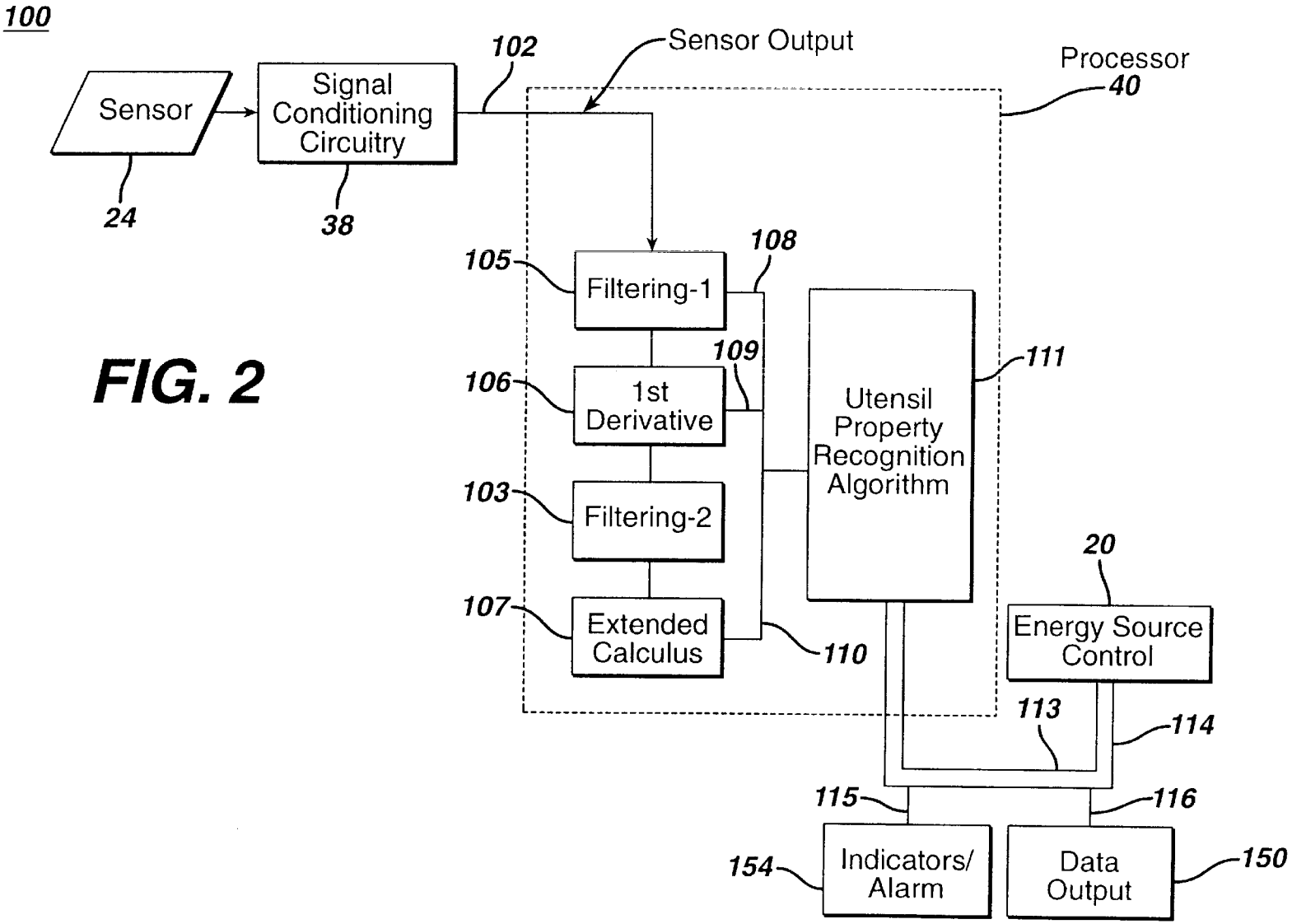
FIG. 2 is a block diagram illustrating a cooktop utensil detector system according to an exemplary embodiment of the present invention.

FIG. 2 is a block diagram showing the components of one embodiment of a detector system 100, including sensors connected to processor 40 for providing input signals to inter-connected calculator functions located within the processor 40. More particularly, sensor indicative of temperature 24 can be, for example, an optical or ambient flux type sensor for generating an optical signal, and is connected to pass a signal to signal conditioning circuitry 38 which is connected to the processor 40. The conditioned optical signal calculated by circuitry 38 is passed via signal line 102 to a filtering/averaging calculator 105. The result calculated by calculator 105 is provided to a first derivative calculator 106 and is also provided via a signal line 108 to a utensil property recognition algorithm calculator 111, which may comprise a software program or which may be embodied in hardware.

The calculated output of the first derivative calculator 106 is provided to a second filtering/averaging calculator 103 and via a signal line 109 to the utensil property recognition algorithm calculator 111 in processor 40. The calculated output of the second filtering/averaging calculator 103 is provided to an extended calculus calculator 107, which in turn provides an extended calculus signal, e.g., a second derivative of the optical signal, via a signal line 110 to the utensil property recognition algorithm calculator 111. Calculator 111 is connected via a data line 116 to a data output circuit 150, via a data line 114 to an energy source control 20, and via a data line 115 to an alarm indicator 154. Alarm indicator 154 may comprise an audible, visual or data indicator for indicating that a predetermined utensil property has been detected. Calculator 111 is also connected via a data line 113 to energy source control 20 for receiving signals indicative of power applied to the energy source 12. Alternatively, a signal indicative of power can be inferred as a result of energy source control signals applied by processor 40 to energy source control 20.

Filters 103 and 105 are used to limit noise in the optical signal in order to simplify the robust determination of the first order derivative as well as the result of the extended calculus result, such as, for example, the second order derivative.

Figure 3:
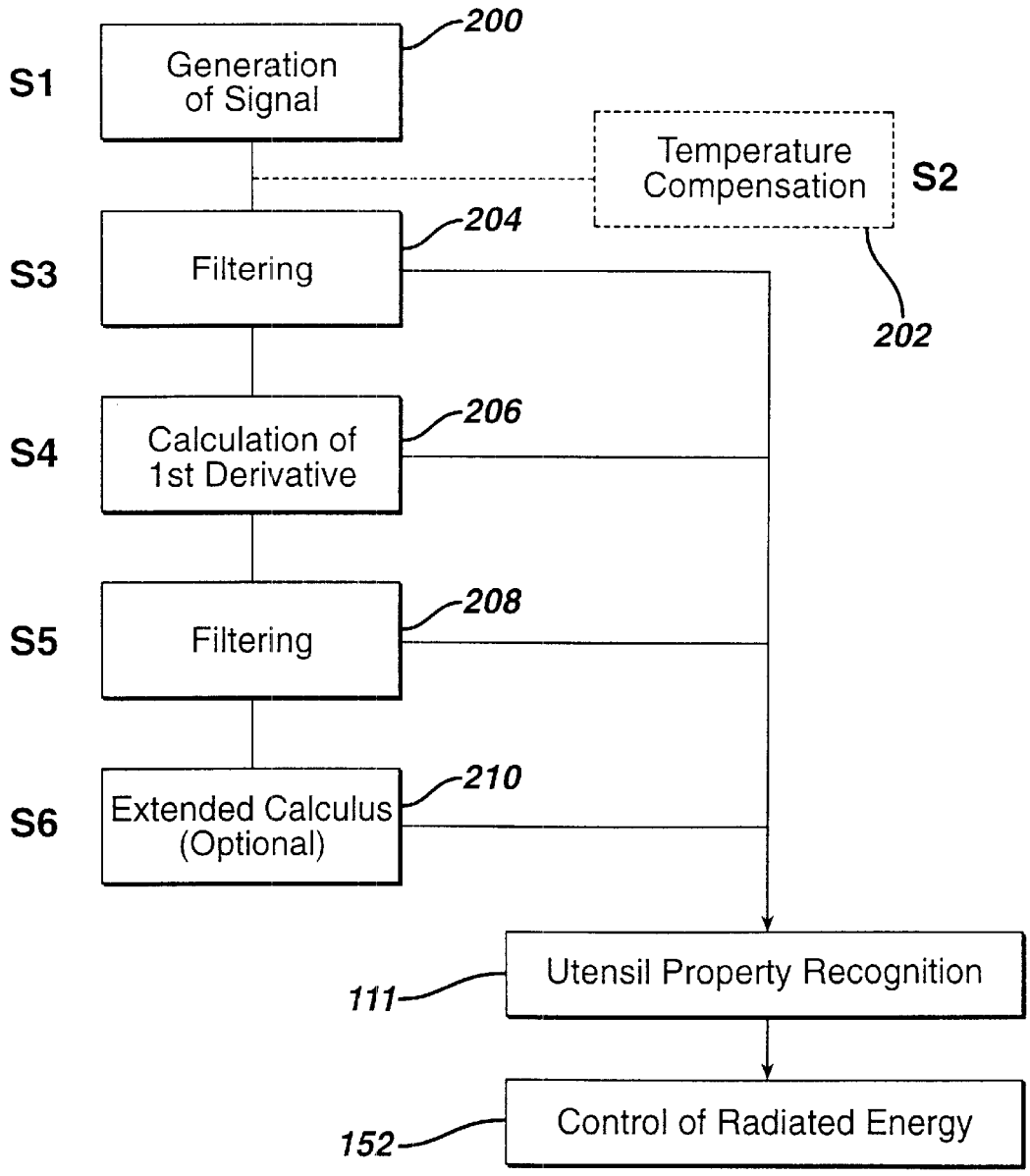
FIG. 3 is a flow chart illustrating an exemplary method of the system shown in FIG. 2.

FIG. 3 is a flow chart illustrating an exemplary method of system 100 shown in FIG. 2. The method illustrated in FIG. 3 begins with step S1 (200), including the generation and conditioning of an optical signal. In one embodiment, in step S2 (202), the conditioned signal is temperature-compensated. The input to step S3 (204) comprises the output of step S1 or optional step S2. Step S3 comprises a filtering calculation, such as filtering or averaging repeatedly or, alternatively, recursively, in order to simplify the determination of utensil properties. The specific implementation depends on the desired utensil properties. The filter calculation substantially removes the noise and enables a robust calculation of the first derivative of the filtered signal in step S4 (206). In one exemplary embodiment, the filter calculation is implemented in such a way that each signal value is replaced by the statistical mean of a number n of prior signal values. The number of points n is a function of the tolerable response delay and is selected such that the utensil properties recognition algorithm determines utensil properties in near real time. In this embodiment, the number n of points is selected to be relatively small (such as, for example, 3–10) so as not to distort any sudden changes in the signal corresponding to utensil properties or the result of the control of the power to facilitate the sensing.

In step S4, the first derivative of the filtered signal is calculated. In particular, an incremental derivative signal is calculated at predetermined time intervals by determining the difference between the current and previous values of the filter signal divided by the time step between the two readings. The result is a smooth and slightly delayed first derivative of the optical signal or signal indicative of the power. For small values of n, the delay is very small.

Optionally, the first derivative obtained in step S4 is provided to step S5 (208), in which a second filtering calculation of the derivative is computed, thereby removing noise and enabling a robust calculation of the extended calculus signal, e.g., a second derivative of the signals in step S6 (210). Whether or not any signal characteristics beyond the first derivative are desirable depends on the utensil properties of interest for a particular application. This second filtering operation is implemented in a substantially similar way to the filtering calculation step S3.

The values calculated in steps S4 through S6 are provided to the utensil property recognition algorithm 111. In an exemplary embodiment, algorithm 111 is an evolutionary algorithm that updates comparison rules in accordance with calculated differences between detector signal levels and known signal patterns, as shown in example signal patterns illustrated in FIGS. 6–8. Output from algorithm 111 is communicated to an energy source control 20, as illustrated in FIG. 2.

Figure 4:
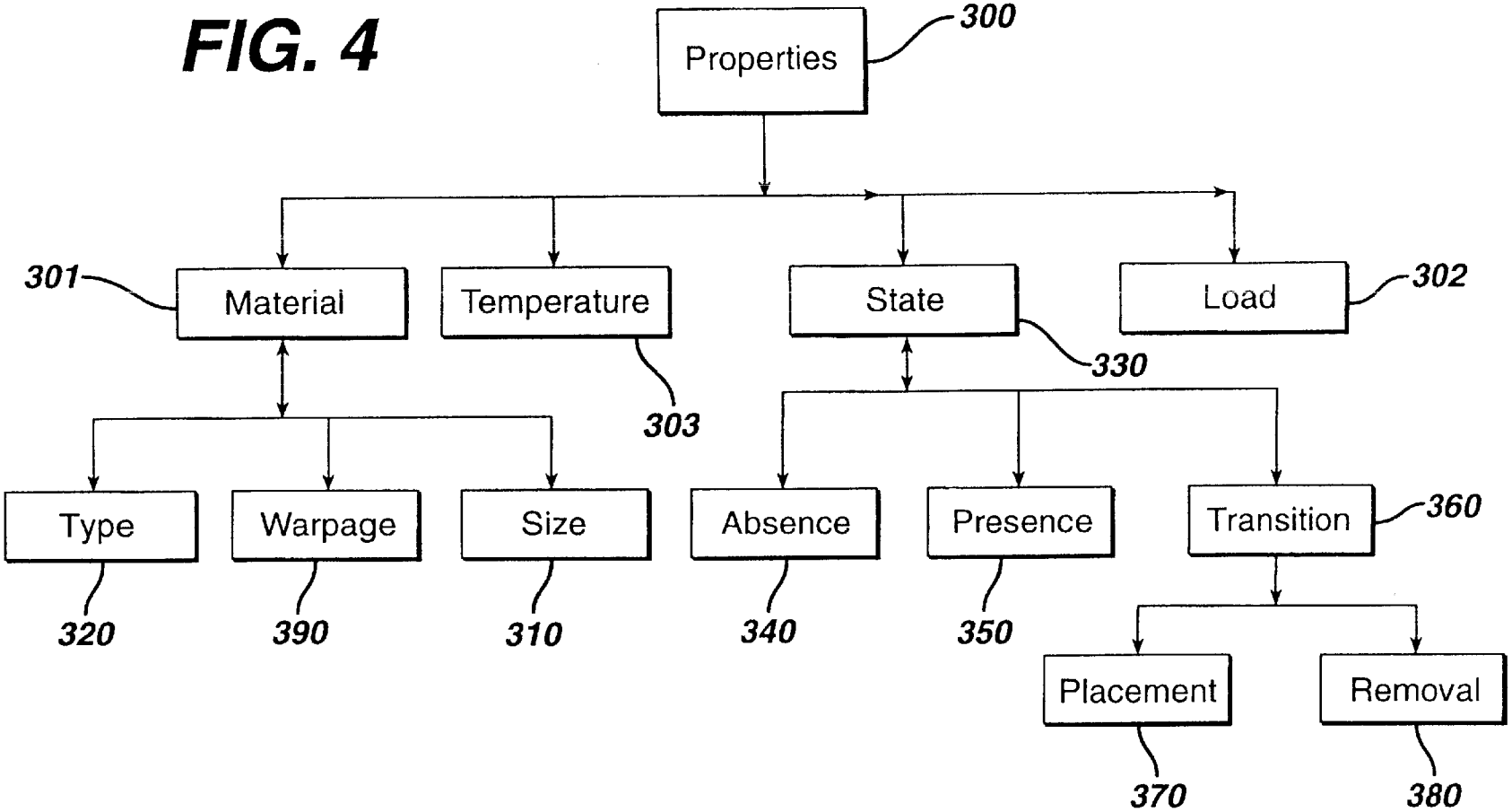
FIG. 4 is a block diagram illustrating exemplary utensil properties and their relationships.

FIG. 4 is a schematic block diagram illustrating utensil properties. Utensil properties are defined by detection of radiation affected by the utensil. Radiation affected by the utensil is a function of utensil material 301, utensil load 302, utensil temperature 303, and utensil state 330. Utensil material 301 is a function of utensil type 320, utensil warpness 390, and utensil size 310. Utensil size generally indicates relative size (small or large) among commonly used utensils. Utensil type refers to whether the utensil is dark or shiny. Utensil state 330 is a function of utensil absence 340, utensil presence 350, and utensil transition 360. Utensil transition 360 is a function of utensil placement 370 and utensil removal 380.

For each utensil property, control of the power is an option. In general, control of the power to facilitate the utensil property determination is defined herein as using the energy source to generate a pulse of energy or heat supplied towards the cooktop and the utensil. Four exemplary properties 300 are utensil load 302, utensil material properties 301, utensil, temperature 303 and utensil state 330. Utensil load generally indicates the amount of food that is contained in the utensil. Utensil material property refers to those properties that include material aspects of the utensil including the type, the size, and the warpage. The utensil state property is shown as comprising three characteristics as follows: utensil absence 340, utensil presence 350, and utensil transition 360, where utensil transition comprises either utensil placement 370 or utensil removal 380.

Figure 5:
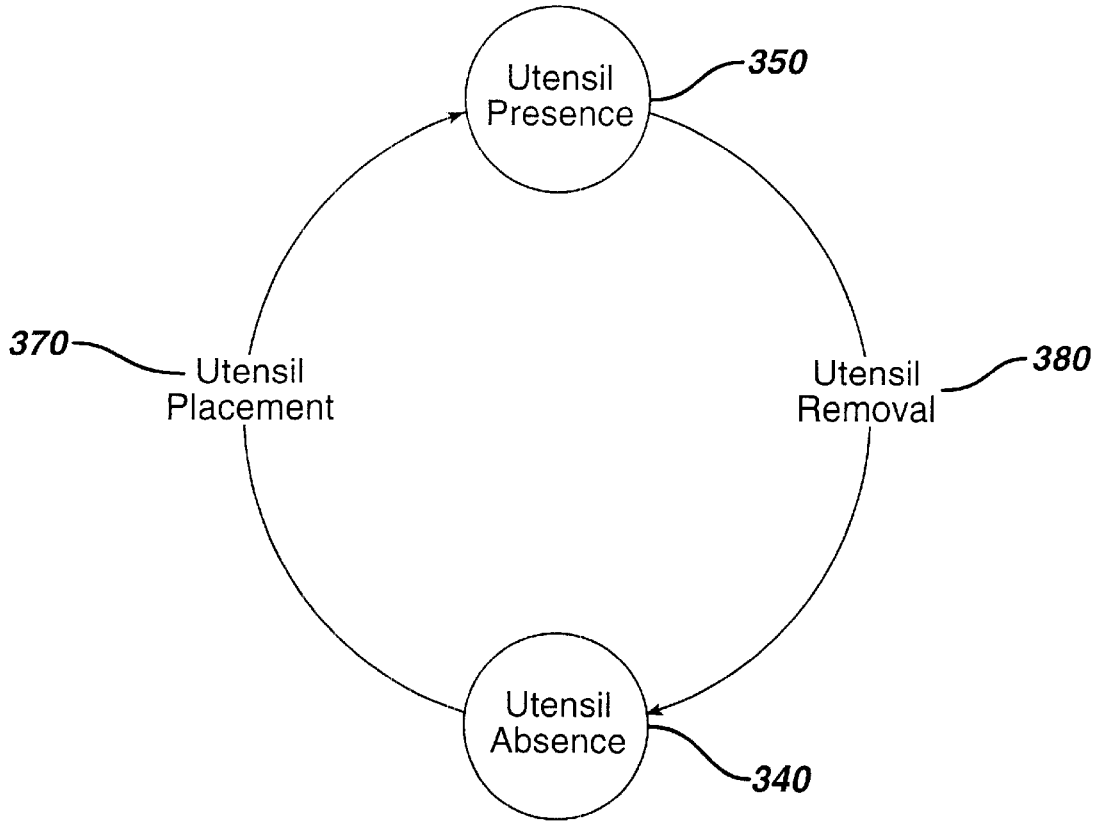
FIG. 5 is a block diagram illustrating utensil placement and removal as the transitions between the two utensil states of absence and presence.

FIG. 5 illustrates in more detail the relationship between two utensil states associated with any utensil in combination with a cooktop. A utensil is either in a presence state 350 or an absence state 340 with respect to a cooktop surface, or the utensil is transitioning between the presence and absence states. The step of transitioning comprises either utensil placement 370 or utensil removal 380.

The radiation reflected from the cooking utensil is utilized to determine the size or type of cooking utensil. Such information is used to control the energy source, which is used as the source of radiation reflected from the cooking utensil. The energy source is initially turned on to provide radiation which is reflected from the cooking utensil, which is then utilized to determine the cooking utensil properties based upon the sensor output. This information is used to select a combination of radiating energy sources, assuming there is more than one source, that optimally matches the cooking utensil size. Signal communication among different heat sources and sensors can be arranged as a single, multiplexing interface. Multiplexing can be accomplished electronically or optically.

Utensil type refers to the shininess of the cooking utensil, for example, the reflective surfaces of Revereware® brand utensils, or the blackness or absorptiveness of dark utensils such as Calaphalon® brand utensils. This affects the amount of heat sent as part of the power control that is used to facilitate the sensing as energy gets reflected or absorbed by the utensil. This reflected heat (or its relative absence) affects the temperature of the cooktop. The change in the temperature of the cooktop that occurs as a result of the power control is related to the utensil type. This change is monitored over a length of time that is short enough not to be affected by the load or the size of the utensil.

Figure 6:
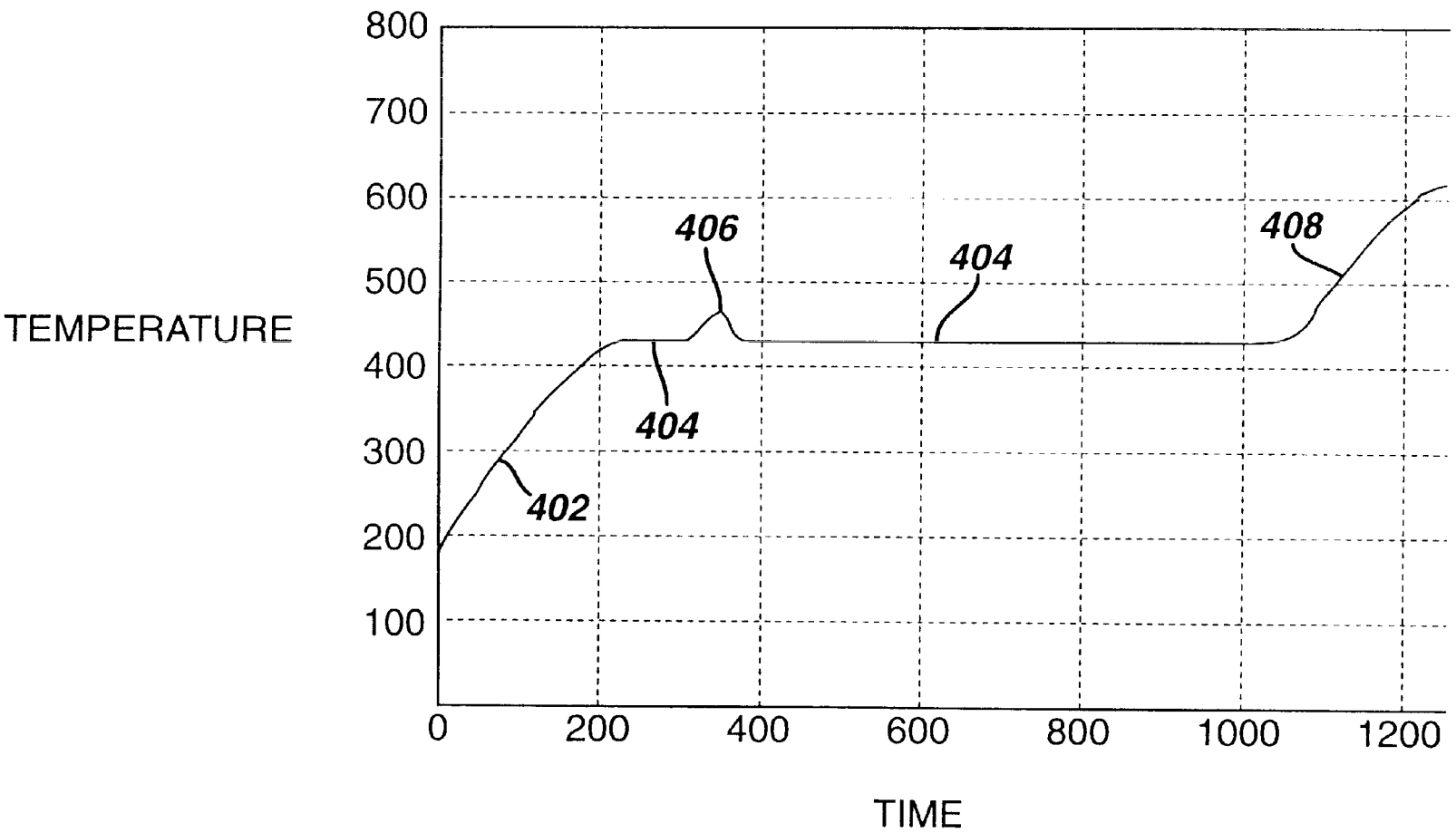
FIG. 6 illustrates typical sensor signal data including boiling, boil dry and pan removal conditions.
Figure 7:
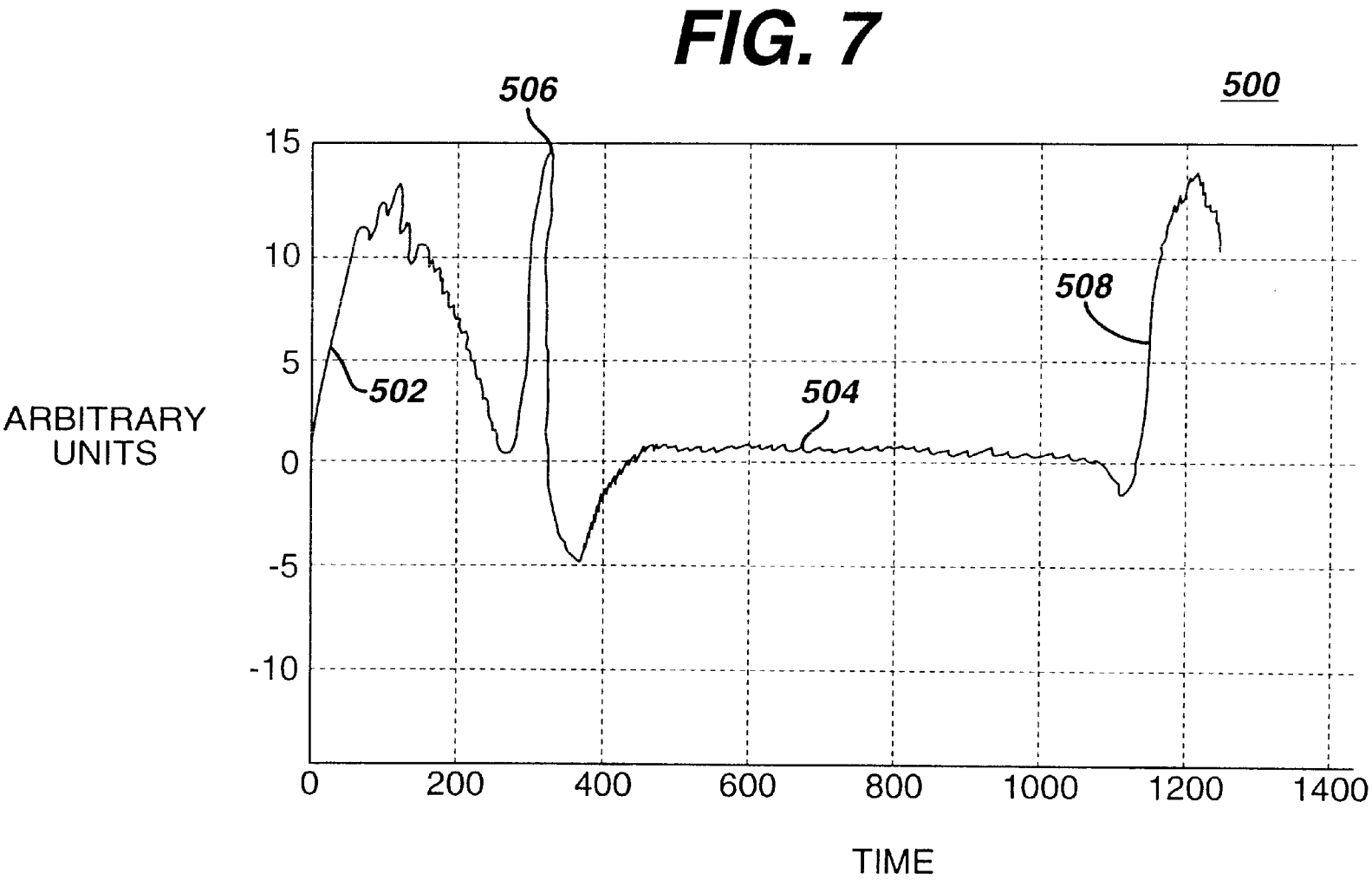
FIG. 7 illustrates the first derivative of the typical sensor signal including boiling, boil dry and pan removal conditions.
Figure 8:
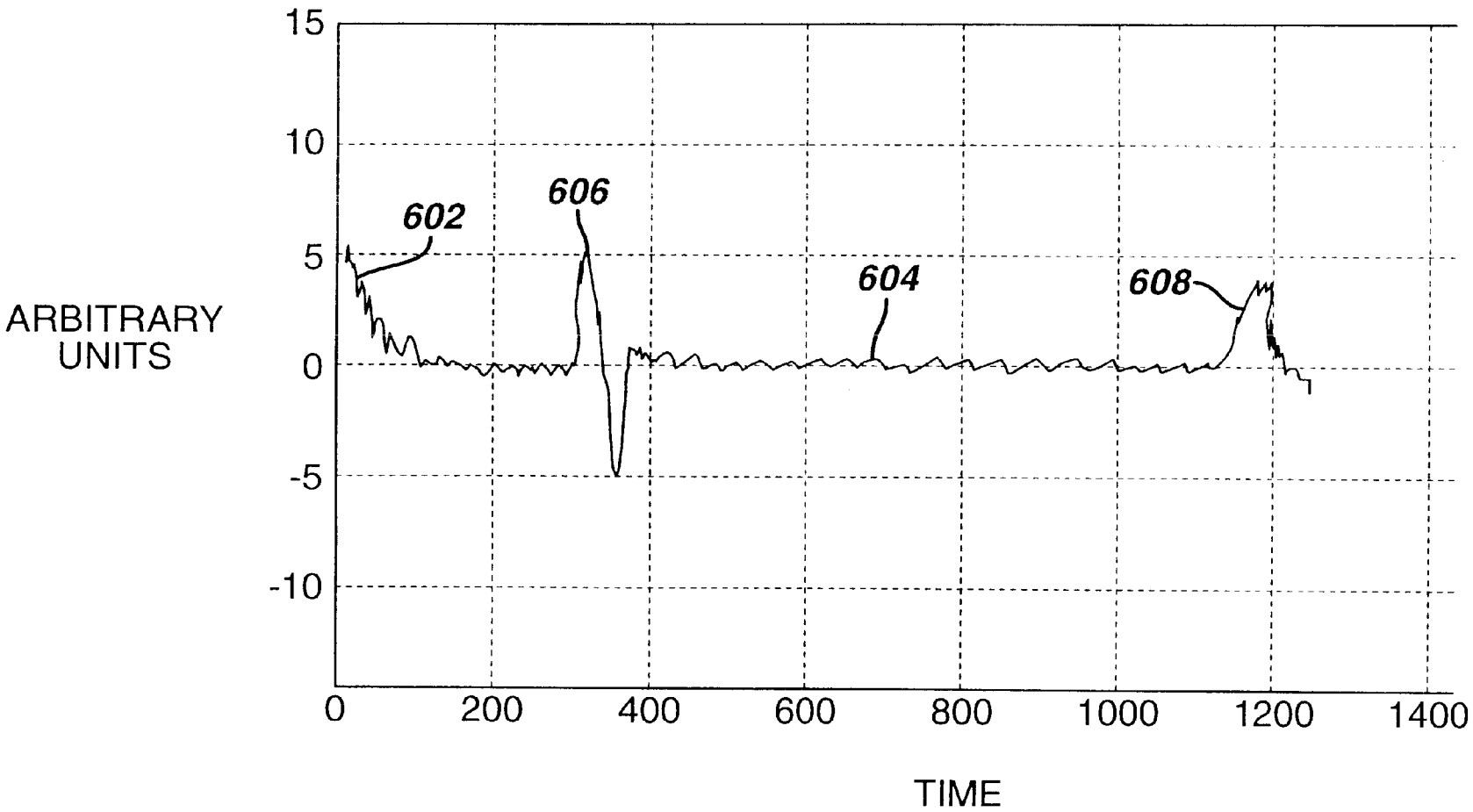
FIG. 8 illustrates the second derivative of the typical sensor signal including boiling, boil dry and pan removal conditions.

Utensil type is determined by using the degree of original rise in temperature of the cooktop as a result of a sudden change in the heat sent by the burner or the energy source. In the preferred embodiment, an evolutionary algorithm is employed that updates comparison rules in accordance with calculated differences between detector signal levels and known signal patterns obtained through experimentation, such as, for example, as illustrated in FIGS. 6–8. For example the algorithm can include selecting a time period substantially during initial phases of utensil heating, and comparing the measured rate of change to a predetermined value expected for a particular cooking utensil type. The predetermined value is defined before the utensil has reached, for example, 30% to 40% of its cooking temperature.

Determination of the size of the utensil is based on either monitoring the initial slope of the temperature or the distribution of the temperature indicative values over space. For a two ring burner arrangement, measurements of the change in the temperature and the distribution of the temperature during a sequence of turning inner and outer burners on and off in different combinations are used, in order to calculate which portion of the burner is covered with a utensil. In a separate embodiment, one or more off center detectors 25, each with a narrow field of view that detects an asymmetrical temperature distribution are employed.

An optional control of the power employed for the utensil size property detection is as follows for a single burner configuration that includes inner and outer burners. Step 1: the inner buyer is turned on for a period of time $T_{on}$ (e.g., 15–°seconds), and is turned off for another period of time $T_{off}$ (e.g., 10–15 seconds). Step 2: the outer, ring-shaped part of the burner is turned on for a period of time $T_{on}$ (e.g., 15–20 seconds), and is turned off for another period of time $T_{off}$ (e.g., 10–15 seconds). Step 3: both the inner and outer parts of the burner are turned on for another period of time $T_{on}$ (e.g., 15–20 seconds), and are turned off for another period of time, $T_{off}$ (e.g., 10–15 seconds).

Cooking utensils are frequently warped so that the bottom is no longer flat. This warpage affects the heat transfer efficiency, and the distribution of temperature across the cooking surface.

Utensil temperature is inferred from the temperature of the cooktop and the determination of the cooking utensil type as detailed above. This is an inferred parameter based on two alternative approaches. In one approach, the values are based on experimentally determined relationships between the cooktop temperature and the utensil temperatures given the previously determined utensil type and size.

In the second approach, models are used for the estimation or inferral of utensil temperature. The heat transfer model is based on the pre-determined type, as well as size, of the utensil incorporate the heat transfer from the energy source to the cooktop and the utensil. According to the present invention, the preferred heat transfer model is obtained by using the power and the heat flux properties, including the conduct ed and radiated heat. This includes using the heat flux, and the power that is being transmitted and reflected by the glass ceramic, the power reflective properties of the utensils based on the pan type, and the air gap between the glass ceramic and the utensil. For example before the utensil has reached 30% to 40% of its cooking temperature.

Utensil placement and removal comprise the transitions between the utensil's presence and absence states, as illustrated in FIG. 5. These transitions are detected by monitoring the relatively abrupt changes in the signal indicating a utensil has been removed or placed on the cooktop. To accomplish this, the first and second derivatives of the temperature indicative parameter (e.g. the temperature of the cooktop) are monitored. Utensil removal will be seen as an increase in the monitored temperature, whereas utensil placement will be a decrease in the temperature, depending on utensil type. The signal outputs from more than one sensor are compared to remove the effects of interference from the cooktop user's movements of the utensil or changes in ambient lighting, or the effects of off-center placement of the utensil. In the single-detector arrangement, the signal is monitored for abrupt "AC" changes, which result in a distinct change in sensor signal signature. For example, separately identifiable signatures representing utensil movement and changes in room lighting can be experimentally determined for a variety of anticipated utensil and lighting arrangements.

Optionally, the calculation algorithm for the placement/removal property includes the detection of a calibration signal value during either a time of non-use or during a designated calibration period. A difference is calculated between the current signal value and the calibration signal value.

Determination of whether a utensil is present on the cooktop above the energy source is obtained from the relative values of the initial derivative (or slope) of the sensor signal. In one embodiment, an autocalibration arrangement is employed in which the current monitored signal value is compared with measurements of the normalized signal, which were taken during a time of non-use or otherwise designated calibration period. In a separate preferred embodiment, use of a training mechanism or evolutionary algorithm to learn and continually update the difference in signal levels is employed. The signal outputs from detectors 25 at one or more locations are compared in order to detect difference between the signals, which are used to infer utensil presence above one or more locations.

Utensil load refers to the amount of food that is contained in the utensil, and is estimated based on the heat transfer or the change in the temperature over relatively long periods of time. This period is defined in terms of the time that takes to raise a known amount of water to a predetermined temperature.

The method of the present invention automatically controls the temperature of the solid surface of the cooktop by a method of calculating a series of feature recognition steps including comparing a plurality of derivative values of the detector signals and a plurality of amplitudes of filtered values of the detector signals. The compared values are evaluated against one of pre-determined values and dynamically calculated values of the detector signals to determine at least one utensil property, which is used to control the energy applied to the cooking surface.

The detector signals are indicative of a cooking utensil type property. At least one detector can be located off-center with respect to a burner so that it detects a portion of a cooking utensil located directly over the detector, thereby determining a value, for example, for the utensil size property.

In the case where the detector signals are indicative of a cooking utensil type property, the method includes selecting a time period substantially during initial phases of utensil heating, comparing a measured rate of change of temperature to a predetermined value expected for a particular cooking utensil type, and forming a result of the comparison, the result being indicative of the utensil type property. The predetermined value can be a predetermined signal pattern indicative of the cooking utensil type property ranging from shiny to dark.

In an implementation having a burner with first and second rings, and wherein the detector signals are indicative of a utensil size property, the method includes measuring a first signal indicative of temperature at a first location disposed over the center of the burner, measuring at least one additional signal indicative of temperature at a location on the cooktop different than the first location, comparing rates of change between the first signal and the at least one additional signal, and forming a result of the comparison, the result being indicative of the utensil size property. The method further includes controlling the first and second rings so as to cycle the first and second rings through a plurality of combinations of energized and de-energized states.

In the case where the detector signals are indicative of a cooking utensil presence/absence property, the method includes monitoring a rate of change of the signal indicative of temperature during initial heating phases, comparing the rate of change of the signal indicative of temperature to a predetermined rate of change of the solid surface cooktop heated without a cooking utensil thereon, and forming a result of the comparison, the result being indicative of the cooking utensil presence/absence property.

In the case where the detector signals are indicative of a utensil state transition property, the method includes monitoring the signal indicative of temperature, detecting an abrupt change in at least one detector signal, the abrupt change indicating placement or removal of a cooking utensil on the cooktop, monitoring the signal indicative of temperature at a time subsequent to initial heating of the utensil, but before other state changes are detected; comparing a value of the monitored signal to at least one predetermined value, and forming a result of the comparison, the result being indicative of cooking utensil load. The step of detecting an abrupt change comprises calculating derivatives of the slope of the monitored signal.

The temperature of the cooking utensil can also be determined by monitoring the signal indicative of temperature and calculating an estimate of the temperature of the cooking utensil using the result indicative of the utensil type property, a predetermined heat transfer model and calibrated measurements. The method further includes comparing the at least one detector signal to a predetermined measurement, the result of the comparison being a determination of a boil-dry condition.

In an alternative embodiment in which the cooktop includes at least one burner having a first power level and arranged to be set to a first controlled power level selected by a user of the cooktop, the method includes changing the first power level of the burner to achieve a second controlled power level. The second controlled power level is arranged to remain at a given value over a predetermined time period. A signal is detected that has a rate of change indicative of at least one of temperature of the burner during the predetermined time period and the power level applied to the burner. A rate of change is calculated for the detected signal.

A series of feature recognition steps are calculated using the calculated rate of change of the detected signal to determine at least one property of the cooking utensil for controlling the temperature of the solid surface cooktop. The power level of the burner is then changed to a third controlled power level based on the determined cooking utensil property. The step of calculating the series of feature recognition steps can include at least one derivative of the calculated rate of change.

The calculation of the series of feature recognition steps is this embodiment includes the step of comparing relative values of successive calculated rates of change during a plurality of the predetermined time periods, wherein the comparison corresponds to a respective cooking utensil property. The measured rate of change of temperature is compared to an expected rate of change of temperature for a given level of temperature or power, wherein the comparison corresponds to a respective cooking utensil property.

In a separate embodiment, the method includes the step of determining a set of probable utensil properties, where each probable property has a respective probability of being a most accurate representation of at least one utensil property.

FIGS. 6–8 represent an example collection of temperature data points represented by smooth signal curves obtained for an arbitrary arrangement of sensors and associated detector technologies. The ordinate axis of each of FIGS. 6–8 is time, set in arbitrary units. The abscissa of FIG. 6 is temperature in degrees Fahrenheit, and is in arbitrary units in FIGS. 7–8. The Different sensor arrangements and parameter details, such as filter specifics, may result in signal curves having some general differences over those shown, however, according to the present invention, the discrete signal features of each curve will be identifiable in those curves and can be associated with corresponding cooking utensil parameters, as discussed below.

FIG. 6 illustrates curve 400 representing typical sensor signal data including boiling, boil dry and pan removal conditions. Signal portion 402 represents an initial calibration to pan type during the load heating period. Signal portion 404 represents the boiling condition; signal portion 406 represents the possible boil dry condition; and signal portion 408 represents the actual boil dry condition. Upon achieving the actual boil dry condition, the pan heats up, as shown the rapid rise of signal portion 408.

FIG. 7 illustrates curve 500 representing the first derivative of the typical sensor signal including boiling, boil dry and pan removal conditions. The signals illustrated in FIGS. 7 and 8 correspond to the first derivative component 106 and extended calculus component 107, respectively, illustrated in FIG. 2. In FIG. 7, Signal portion 502 corresponds to portion 402, and represents the initial calibration to pan type during the load heating period. Signal portion 504 corresponds to signal 404 and represents the boiling condition. Signal portion 506 corresponds to signal 406, representing the possible boil dry condition, and similarly, signal portion 508 represents the actual boil dry condition.

FIG. 8 illustrates curve 600 representing the second derivative of the typical sensor signal including boiling, boil dry and pan removal conditions. Again, the points shown in FIGS. 7 and 8 appear as points 602, 604, 606, and 608, representing, respectively, initial calibration, boiling condition, possible boil dry condition, and actual boil dry condition.

While preferred embodiments of the invention have been described herein, those skilled in the art will recognize that such embodiments have been provided by way of example only. Numerous variations, changes and substitutions will occur to those of skill in the are without departing from the invention herein. Accordingly, it is intended that the invention be limited only by the spirit and scope of the appended claims.

What is claimed is:

1. A system for detecting properties of a cooking utensil on the cooking surface of a solid-surface cooktop having at least one controllable energy source for providing energy for heating the utensil and any contents thereof, said detected properties being parameters for controlling said at least one controllable energy source, the system comprising:

a radiation source for emitting radiation toward the cooktop and the utensil;

a detector for detecting a parameter indicative of the temperature of a portion of said cooktop and passing through the cooktop and for generating detector signals indicative of at least one property of the cooking utensil, the at least one property being selected from a group of properties consisting of utensil absence, utensil presence, utensil placement, utensil removal, utensil size, utensil warpage, utensil type, utensil temperature, and utensil load;

at least one power signal indicative of the level of power supplied to at least one controllable energy source having a power configuration; and processor means for receiving the detector signals and the at least one power signal and for providing signals indicative of the at least one property of the cooking utensil.

2. The system of claim 1, further comprising an indicator for providing output signals indicative of the detected properties of the utensil, the indicating means being selected from a group consisting of visual indicating means, audible indicating means and data indicating means.

3. A system for automatically controlling the temperature of a solid surface cooktop by detecting properties of a cooking utensil located on a cooking surface of the cooktop, comprising:

at least one controllable energy source located relative to the cooktop so as to heat the cooktop and the cooking utensil;

a power configuration including power level, power-on and power-off cycle times;

at least one power signal indicative of the level of power supplied to the at least one controllable energy source in response to the power configuration;

at least one sensor arranged to sense a parameter selected from a group of parameters including a parameter related to the cooktop and a parameter related to the cooking utensil, said at least one sensor being further arranged to issue a parameter signal indicative of the sensed parameter; and a signal processing device connected to said at least one controllable energy source and to said at least one sensor for receiving the issued parameter signal and arranged to receive the at least one power indicative signal, said signal processing device being arranged to process the received parameter signal and the power indicative signal to detect a known signal pattern indicating at least one property of the cooking utensil for controlling the temperature of said solid surface cooktop.

4. The system of claim 3, further comprising at least one control device connected to the at least one controllable energy source and the signal processing device to responsively control energy generated by the at least one controllable energy source.

5. The system of claim 4 wherein the at least one property includes at least one property selected from a group of properties including of utensil absence, utensil presence, utensil placement, utensil removal, utensil size, utensil warpage, utensil type, utensil temperature, and utensil load.

6. The system of claim 4 wherein the at least one sensor detects energy from a path selected from a group of paths including a first path including energy conducted through the cooking utensil and the cooktop, a second path including radiation from a lower surface of the cooktop below the cooking utensil, and a third path including radiation from a portion of the cooktop.

7. The system of claim 4 further comprising at least one control device connected to the signal processing device, said at least one control device being responsive to said signal processing device for controlling energy generated by the at least one energy source.

8. The system of claim 4 wherein the sensed parameter is temperature.

9. The system of claim 4 wherein the cooktop has an upper and a lower surface, said at least one controllable energy source and an associated, respective sensor being located below the lower surface of the cooktop.

10. The system of claim 4 further comprising at least one control device for controlling energy generated by the at least one energy source, said at least one control device being connected to the signal processing device.

11. The system of claim 4 wherein said at least one sensor signal is temperature compensated so that said at least one sensor signal is insensitive to ambient temperatures.

12. The system of claim 4 wherein said at least one sensor is selected from a group of sensors comprising a thermal sensor, a resistance temperature detector, a thermocouple, and a sensor indicative of temperature.

13. The system of claim 4 further comprising an indicator connected to the signal processing device, the indicator being arranged to generate a signal responsive to an output of said signal processing device.

14. The system of claim 4 wherein the signal processing device is arranged to calculate a set of probable utensil properties, each probable property having a respective probability of being a most accurate representation of an actual utensil property.

15. A method for detecting properties of a cooking utensil on the cooking surface of a solid-surface cooktop having at least one controllable energy source for providing energy for heating the utensil and any contents thereof, said detected properties being parameters for controlling said at least one controllable energy source, the method comprising:

detecting radiation through and from the cooktop and providing detector signals indicative thereof;

receiving at least one power signal indicative of level of power supplied to at least one controllable energy source having a power configuration including power level, power on, power off cycle times; and comparing the detector signals and power signals to predetermined signal patterns for determining at least one property of the cooking utensil, the at least one property being selected from a group of properties consisting of utensil presence/absence state, placement/removal state, utensil type, utensil size, utensil warpage, utensil temperature, and utensil load.

16. The method of claim 15, further comprising calculating a series of feature recognition steps including comparing a plurality of derivative values of the detector signals and a plurality of amplitudes of filtered values of the detector signals;

evaluating said comparison against one of pre-determined values and dynamically calculated values of the detector signals to determine at least one utensil property; and controlling the energy applied to the cooking surface based on said determination of at least one utensil property.

17. A method for automatically controlling the temperature of a solid surface cooktop by detecting the properties of a cooking utensil located on a cooking surface of the cooktop, comprising:

generating at least one signal having a signal value indicative of temperature related to at least one of the cooktop surface and the cooking utensil;

generating at least one power signal indicative of a power level applied to the cooktop from a controllable energy source;

calculating a series of feature recognition steps using said at least one sensor signal and said at least one power signal indicative of power to determine from said calculation at least one property of the cooking utensil for controlling the temperature of said solid surface cooktop; and controlling the temperature of the solid surface cooktop based on said determined at least one property.

18. The method of claim 17 wherein calculating a series of feature recognition steps includes:

correcting the sensor signal for ambient temperature to achieve a corrected sensor signal value;

deriving at least one filtered value indicative of the corrected sensor signal value;

calculating at least one respective characteristic of the at least one derived filtered value;

calculating at least one derivative value of at least one of the sensor signal value and the corrected sensor signal value; and using the results of the feature recognition steps to control the temperature of the cooktop.

19. The method of claim 17 wherein the step of calculating a series of feature recognition steps includes measuring a value selected from a group of values including a rate of change and a pattern of change of the signal indicative of temperature during at least one predetermined period of time during which the cooking utensil is heated.

20. The method of claim 18 wherein the at least one respective characteristic includes one of a first order derivative of the filtered value, a higher order derivative of the filtered value, or a combination of a first and a higher order derivative of the filtered value.

21. The method of claim 18 wherein the step of calculating at least one respective characteristic further comprises at least one comparison step selected from a group of comparison steps including comparing the relative values of the signal indicative of temperature during a plurality of predetermined periods of time during which the cooking utensil is heated, and comparing the signal indicative of temperature to an expected rate of change for a given power level.

22. A method for automatically controlling the temperature of a solid surface cooktop, said cooktop including a sensor including at least one detector for detecting detector signals, said detector signals including a signal indicative of temperature of a cooking utensil located on a cooking surface of the cooktop, comprising:

calculating a series of feature recognition steps including comparing a plurality of derivative values of the detector signals and a plurality of amplitudes of filtered values of the detector signals;

evaluating said comparison against one of pre-determined values and dynamically calculated values of the detector signals to determine at least one utensil property; and controlling the energy applied to the cooking surface based on said determination of at least one utensil property.

23. The method of claim 22 further comprising the step of determining a set of probable utensil properties, each probable property having a respective probability of being a most accurate representation of at least one utensil property.

24. The method of claim 22, wherein said method further comprises the step of generating control signals for controlling the energy supplied based on the detector signals.

25. The method of claim 24 wherein the detector signals are indicative of a cooking utensil type property, the method further comprising:

selecting a time period substantially during initial phases of utensil heating;

comparing a measured rate of change of temperature to a predetermined value expected for a particular cooking utensil type, and forming a result of the comparison, said result being indicative of said utensil type property.

26. The method of claim 24 wherein the detector signals are indicative of a utensil state transition property, the method further comprising:

monitoring the signal indicative of temperature; and detecting a change in at least one detector signal, the change indicating placement or removal of a cooking utensil on the cooktop.

27. The method of claim 26, further comprising:

monitoring the signal indicative of temperature at a time subsequent to initial heating of the utensil, but before other state changes are detected;

comparing a value of said monitored signal to at least one predetermined value; and forming a result of said comparison, said result being indicative of cooking utensil load.

28. The method of claim 25, wherein said temperature of a cooking utensil is determined by:

monitoring said signal indicative of temperature; and calculating an estimate of said temperature of the cooking utensil using said result indicative of said utensil type property, a predetermined heat transfer model and calibrated measurements.

29. The method of claim 25 wherein the predetermined value is a predetermined signal pattern indicative of the cooking utensil type property ranging from shiny to dark.

30. The method of claim 28, wherein the step of detecting an abrupt change comprises calculating derivatives of the slope of the monitored signal.

31. The method of claim 28, further comprising the step of:

comparing said at least one detector signal to a predetermined measurement, the result of said comparison being a determination of a boil-dry condition.

* * * * *